US009750998B2

(12) United States Patent
Dawson et al.

(10) Patent No.: US 9,750,998 B2
(45) Date of Patent: Sep. 5, 2017

(54) ATTACHABLE SPORTS TRAINING DEVICE

(71) Applicant: Davinci Sports International, Inc., Fort Lauderdale, FL (US)

(72) Inventors: Dale A Dawson, Davie, FL (US); Warren Bottke, Palm Beach Gardens, FL (US); Alan Kleinman, Davie, FL (US)

(73) Assignee: Davinci Sports International, Inc., Sunrise, FL (US)

( * ) Notice: Subject to any disclaimer, the term of this patent is extended or adjusted under 35 U.S.C. 154(b) by 390 days.

(21) Appl. No.: 13/961,645

(22) Filed: Aug. 7, 2013

(65) Prior Publication Data

US 2014/0045627 A1 Feb. 13, 2014

Related U.S. Application Data

(60) Provisional application No. 61/680,540, filed on Aug. 7, 2012.

(51) Int. Cl.

| | |
|---|---|
| ***A63B 57/00*** | (2015.01) |
| ***A63B 69/00*** | (2006.01) |
| ***A63B 69/36*** | (2006.01) |
| *A63B 71/06* | (2006.01) |

(52) U.S. Cl.

CPC ..... *A63B 69/3641* (2013.01); *A63B 69/00* (2013.01); *A63B 69/0057* (2013.01); *A63B 2071/0694* (2013.01); *A63B 2210/50* (2013.01); *A63B 2220/20* (2013.01); *A63B 2225/09* (2013.01); *A63B 2225/093* (2013.01)

(58) Field of Classification Search

CPC ..... A63B 69/0059; A63B 2225/093; A63B 69/3623; A63B 69/00; A63B 69/0071; A63B 69/0002; A63B 2069/0006; A63B 2069/0008; A63B 69/0057

USPC ..... 473/422, 457, 461, 463, 559, 564, 219

See application file for complete search history.

(56) References Cited

U.S. PATENT DOCUMENTS

| | | | | | |
|---|---|---|---|---|---|
| 208,158 | A * | 9/1878 | Cushing | E04H 15/60 | 135/114 |
| 418,378 | A * | 12/1889 | McAlpine | D06F 53/04 | 135/114 |
| 869,128 | A * | 10/1907 | Autenrieth | A45B 3/00 | 135/66 |
| 1,888,972 | A * | 11/1932 | Chittim | E04H 15/46 | 135/116 |
| 2,234,638 | A * | 3/1941 | Topping | A63B 69/3632 | 473/206 |
| 3,421,529 | A * | 1/1969 | Vestal | A61H 3/00 | 135/67 |
| 3,733,077 | A * | 5/1973 | Fennell | A63B 69/3632 | 473/233 |

(Continued)

*Primary Examiner* — Mitra Aryanpour

(74) *Attorney, Agent, or Firm* — Christopher & Weisberg, P.A.

(57) ABSTRACT

A sports training device including a first elongate rod. A user engagement element is coupled to the first elongate rod. A second elongate rod is longitudinally aligned with respect to the first elongate rod. A second engagement element is coupled the second elongate rod. A first stopper is movably coupled to the second elongate rod and a second stopper is movably coupled to the second elongate rod. A portion of the first elongate rod is slideable between the first stopper and the second stopper.

18 Claims, 9 Drawing Sheets

(56) References Cited

U.S. PATENT DOCUMENTS 3,844,279 A * 10/1974 Konvalin ..... A61F 5/0125 602/16
4,145,054 A * 3/1979 Stewart ..... A63B 69/3632 473/227
4,399,994 A * 8/1983 Hourihan ..... A63B 21/0004 473/208
4,819,944 A * 4/1989 Doane ..... A63B 49/08 473/256
4,846,203 A * 7/1989 Tappel ..... A61H 3/02 135/69
4,917,126 A * 4/1990 Ellmore ..... A61H 3/02 135/69
4,969,921 A * 11/1990 Silvera ..... A63B 69/3632 473/234
5,174,575 A * 12/1992 Leith ..... A63B 69/0059 473/213
5,176,377 A * 1/1993 Wilkinson ..... A63B 21/4025 482/114
D356,135 S * 3/1995 Slusher ..... D21/756
5,544,877 A * 8/1996 Brownell ..... A63B 69/0059 473/450
5,762,565 A * 6/1998 Milam ..... A63B 69/0057 473/269
5,865,685 A * 2/1999 Thomas ..... A63B 69/3608 473/213
5,865,695 A * 2/1999 Mahala ..... A63B 69/0071 473/450
5,954,598 A * 9/1999 Carlson ..... A63B 24/0021 473/458
6,453,921 B1 * 9/2002 Rost ..... A61H 3/00 135/67
6,471,598 B2 * 10/2002 Takase ..... A63B 69/0059 473/207
6,503,148 B2 * 1/2003 Lane ..... A63B 69/3608 473/215
6,557,571 B1 * 5/2003 Schultz ..... A61H 3/02 135/114
6,899,633 B1 * 5/2005 Kienzle ..... A63B 69/3635 473/224
7,156,748 B2 * 1/2007 Burke ..... A63B 69/0059 473/207
7,172,522 B1 * 2/2007 Harvey ..... A63B 69/0071 473/450
7,326,134 B2 * 2/2008 Collucci ..... A63B 49/08 473/551
7,455,595 B1 * 11/2008 Gibbons ..... A63B 69/3608 473/212
7,547,256 B1 * 6/2009 Petrie ..... A63B 69/0059 473/207
7,654,921 B2 * 2/2010 Brunst ..... A63B 69/0002 473/422
8,167,742 B1 * 5/2012 McNee ..... A63B 69/3608 473/212
8,409,037 B2 * 4/2013 Imatoh ..... A63B 21/0088 473/422
8,506,427 B2 * 8/2013 Webb ..... A63B 69/0002 473/422
2004/0043824 A1 * 3/2004 Uzelac ..... A63B 69/0059 473/266
2005/0202896 A1 * 9/2005 Burke ..... A63B 69/0059 473/276
2006/0122000 A1 * 6/2006 Paredes ..... A63B 69/3638 473/219
2007/0155523 A1 * 7/2007 Lesko ..... A63B 69/3632 473/212
2009/0227384 A1 * 9/2009 Reynolds ..... A63B 69/0059 473/207
2010/0167830 A1 * 7/2010 Hinton ..... A63B 69/3632 473/239

* cited by examiner

ATTACHABLE SPORTS TRAINING DEVICE

CROSS-REFERENCE TO RELATED APPLICATION

This application is related to and claims priority to U.S. Provisional Patent Application Ser. No. 61/680,540, filed Aug. 7, 2012, entitled SPORTS TRAINING DEVICE AND SYSTEM, the entirety of which is incorporated herein by reference.

STATEMENT REGARDING FEDERALLY SPONSORED RESEARCH OR DEVELOPMENT n/a

FIELD OF THE INVENTION

The present invention relates to attachable sports training devices, and in particular, devices that train users to achieve proper swing biomechanics when using a sports device such as a golf club.

BACKGROUND OF THE INVENTION

A proper swing in contact sports, in which the object is to contact a ball, is paramount for success. A proper golf swing, however, is not simple—many different muscles and forces are involved that depend on biomechanics and physics to achieve a desired swing. However, no one athlete has the same body type, and different athletes have different relative strengths and weakness that contribute to a particular motion during a golf swing. Certain aspects of a proper golf swing require certain body movements and club orientations to achieve the proper swing. For example, in a golf swing it is important to the golfer's wrists and forearms in proper alignment during the backswing, downswing, and follow-through. To improve on these aspects of a proper swing, building muscle memory and/or motor skills through repetition of a proper swing is important.

Current sports training devices designed to affect an athlete's swing, however, focus on a single aspect of the swing rather than the entire range of motion. For example, current devices may target one muscle or one specific movement among the many muscles and movements involved in a swing. Thus, current devices may over train certain muscles and under train others, and thus are not particularly effective at training the athlete at the particular aspects of a proper swing based on the athlete's own body mechanics. Similarly, in other sports such as baseball, tennis, and hockey, there are a lack of devices that train the user to use the proper muscles during the entire swing.

SUMMARY OF THE INVENTION

The present invention advantageously provides a sports training device including a first elongate rod. A user engagement element is coupled to the first elongate rod. A second elongate rod is longitudinally aligned with respect to the first elongate rod. A second engagement element is coupled the second elongate rod. A first stopper is movably coupled to the second elongate rod and a second stopper is movably coupled to the second elongate rod. A portion of the first elongate rod is slideable between the first stopper and the second stopper.

In another embodiment, the sports training device includes a first elongate rod having a first length, a first end, and a second end. A coupling element disposed at the first end is included, the coupling element has a second length less than the first length, the coupling element further defines a passage there through. A user engagement element is coupled to the second end. A second elongate rod is slideably received within the passage. A second engagement element is coupled to the second elongate rod. A first collar and a second collar are movably coupled to the second elongate rod. The coupling element is slideable between the first collar and the second collar.

In yet another embodiment, the sports training device includes a first elongate rod having a first length, a first end, and a second end. A coupling element is disposed at the first end the coupling element has a second length less than the first length, the coupling element further defines a passage there through. A user engagement element is rotatably coupled to the second end. A second elongate rod is slideably received within the passage. A second user engagement element is pivotally and rotatably coupled the second elongate rod. A first collar and a second collar are movably coupled to the second elongate rod. The coupling element is slideable between the first collar and the second collar.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
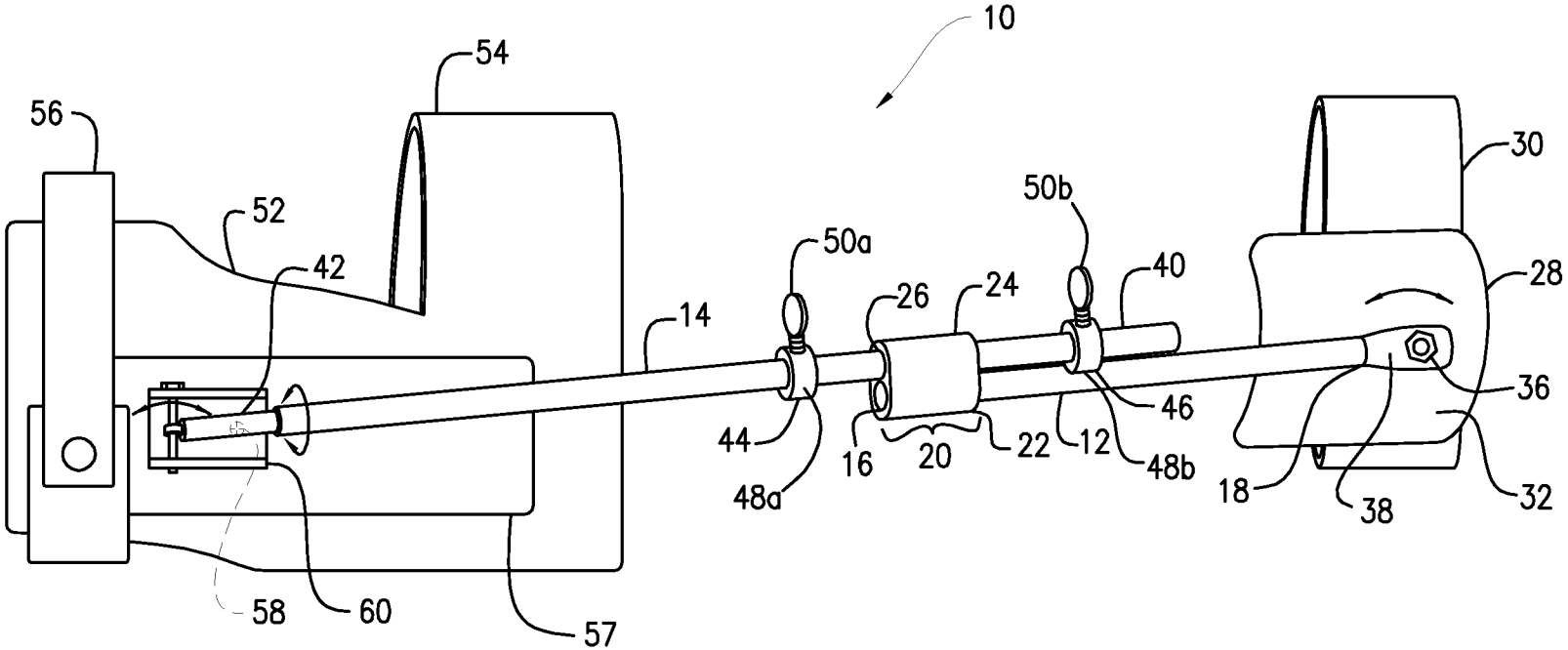
FIG. 1 is a front perspective view of an attachable sports training device constructed in accordance with the principles of the present invention.

Now referring to the drawings in which like reference designators refer to like elements, there is shown in the drawings an attachable sports training device constructed in accordance with the principles of the present invention and designated generally as "10." The device 10 may include a first elongate rod 12 and a second elongate rod 14 slideable with respect to each other. The first elongate rod 12 may be hollow or solid and may be substantially linear, or curvilinear in shape. In the configuration shown in FIG. 1, the first elongate rod 12 is cylindrical in shape and is composed of a metallic material such as aluminum or steel. In other configurations, the first elongate rod 12 may be composed of any substantially rigid material, for example, polycarbonates or composites, and may define any shape.

The first elongate rod 12 includes a first end 16 and a second end 18. A coupling element 20 is affixed to the first end 16 of the first elongate rod 12 and is configured to engage a portion of the second elongate rod 14. The coupling element 20 may be circumferentially disposed about the first end 16 and may extend a longitudinal distance away from the first end 16 along the length of the first elongate rod 12. In the configuration shown in FIG. 1, the coupling element 20 includes two cylindrical portions. A first cylindrical portion 22 is circumferentially disposed about and permanently affixed to the first elongate rod 12. That is, movement of the first elongate rod 12 also moves the coupling element 20. A second cylindrical portion 24 is molded or otherwise coupled to the first cylindrical portion 22 and defines a passage 26 therein sized to slideably receive the second elongate rod 14. For example, the second cylindrical portion 24 may be positioned adjacent the first cylindrical portion 22 and includes a diameter larger than the diameter of the second elongate rod 14 such that the second elongate rod 12 slides within the passage 26. Although the coupling element 20 is shown as two cylindrical structures, the coupling element 20 may define any shape or size sufficient to facilitate the sliding movement of the first elongate rod 12 and the second elongate rod 14 with respect to each other. The passage 26 may further operate to longitudinally align the first elongate rod 12 with respect to the second elongate rod 14 such that both rods may longitudinally slide with respect to each other. For example, the passage 26 is configured to align the second elongate rod 14 such that the second elongate rod 14 is at least substantially parallel with respect to the first elongate rod 12.

Continuing to refer to FIG. 1, an arm engagement element 28 may be movably coupled to the first end 18 of the first elongate rod 12. The arm engagement element 28 may be sized to releasably engage with a user's arm, for example, around a user's biceps. In a particular configuration, the wrist engagement element 28 may include an adjustable strap 30 sized to be wrapped around the user's arm and may further include a hook and loop fastener, or another fastener, such that the strap 30 is releasably securable to the user's arm. The arm engagement element 28 may further include an arm plate 32 receiving or otherwise engaged with a portion of the strap 30. The arm plate 32 may be sized to be positioned over a portion of the user's arm, for example, the user's triceps, and may be composed of a substantially rigid material, for example, plastic. The arm plate 32 may be any shape and in an exemplary embodiment is polygonal in shape and may include a first pad 33 (best seen in FIG. 2) on its interior surface to provide a cushioned surface when in contact with the user's arm. The arm plate may 32 define one or more slots 34 (seen in FIG. 2) on its interior surface sized to receive the strap 30, such that the strap 30 may be snugly fit against the arm of the user. The strap 30 may further include a second pad 35 releaseably securably to the interior surface of the strap 30 on the opposite side of the first pad 33. The second pad 35 may provide the user with a feeling of contact between the inner arm and the chest during a swing.

The arm engagement element 28 may be affixed to the exterior surface of the arm plate 32 by including a securing element 36 moveably engageable to a portion of the first elongate rod 12. The securing element 36 may be a screw or nut configured to rotatably affix an extension element 38 extending from the second end 18 of the first elongate rod 12. For example, a substantially flat and paddle shaped extension element 38 may be affixed to the second end 18 and may define an aperture (not shown) sized to receive the securing element 36. The extension element 38, and thereby the first elongate rod 12, may rotate 360 degrees about the arm plate 32 while remaining secured to the arm plate 36.

Continuing to refer to FIG. 1, the second elongate rod 14 has a first end 40 and a second end 42 and is slideably received within the passage 26 of the coupling element 20. The second elongate rod 14 may have a diameter commensurate with the diameter of the first elongate rod 12 and smaller than the diameter of the passage 26 to allow the second elongate rod 14 to slide within the passage 26. The second elongate rod 14 may have the same, smaller, or larger diameter than the first elongate rod 12.

A first stopper 44 and a second stopper 46 are movably coupled to the second elongate rod 14 proximate the first end 40 of the second elongate rod 14. The first stopper 44 and the second stopper 46 may be identical or may be different in structure. In an exemplary configuration, both the first stopper 44 and the second stopper 46 are movably couplable with the second elongate rod 14. In particular, the first stopper 44 and the second stopper 46 may each include collars 48*a* and 48*b* respectively, circumferentially disposed around the second elongate rod 14. The collars 48*a* and 48*b* may be composed of metal or other rigid material and are configured to restrict movement of the coupling element 20 between the first stopper 44 and second stopper 46. The first stopper 44 and the second stopper 46 may each include lock screws 50*a* and 50*b* respectively. The lock screws 50*a* and 50*b* may be insertable within an aperture (not shown) in the collars 48*a* and 48*b*, respectively. The lock screws 50*a* and 50*b* may be loosened and tightened to secure and unsecure the first stopper 44 and the second stopper 46 to the second elongate rod 14. In an exemplary configuration, the coupling member 20 is disposed between the first stopper 44 and the second stopper 46, such that it is slideable and rotatable between the first stopper 44 and the second stopper 46. While the first stopper 44 and the second stopper 46 may be spaced any distance apart from each other along the length of the second elongate rod 14, in the configuration shown in FIG. 1, they are spaced approximately 4 inches apart. The first elongate rod 12 and the second elongate rod 14 may further include one or more suitable index, for example, distance markers (not shown), or notches (not shown), that measure predetermined distances or particular locations along the elongate rods at which the first stopper 44 and the second stopper 46 may movably affix.

Continuing to refer to FIG. 1, a wrist engagement element 52 may be pivotally and rotatably coupled to the second end 42 of the second elongate rod 14. The wrist engagement element 52 may be sized to wrap around a portion of the user's wrist and/or hand. The wrist engagement element 52 may include a cuff 54 configured to wrap around the user's wrist and a strap 56 configured to loosen and tighten the wrist engagement element 52 to the user. Similar to the arm engagement element 28, the wrist engagement element 52 may include a plate 57, which may be rigid or flexible. A securing element 58 is rotatably affixed to the plate 57 and is configured to rotatably and pivotally secure the second elongate rod 14 to the wrist engagement element 52. The securing element 58 may include a fulcrum 60 pivotally coupled to the second end 42 of the second elongate rod 14. In an exemplary configuration the securing element 58 enables 360 degrees rotation of the second elongate rod 14 about the plate 57 and the fulcrum 60 enables the second elongate rod 14 to pivot 180 degrees about the plate 57.

Figure 2:
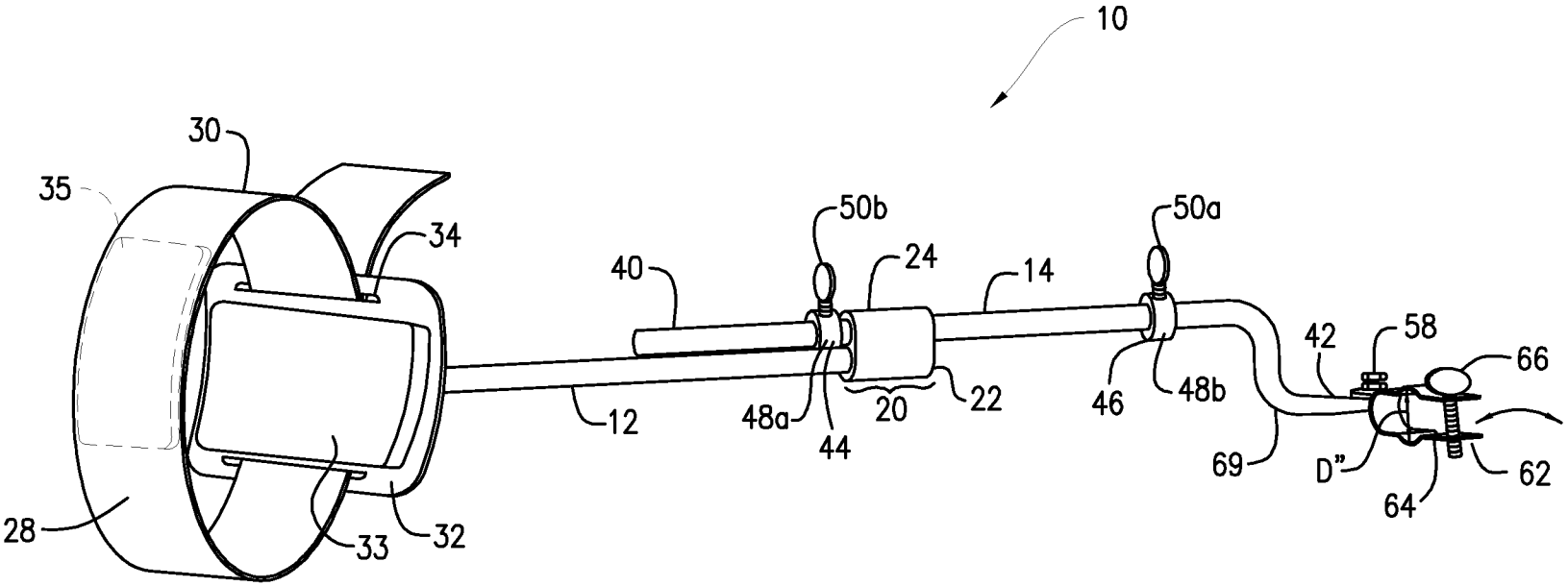
FIG. 2 is a front perspective view of another embodiment of the attachable sports training device constructed in accordance with the principles of the present invention attachable to a sports device.

Referring now to FIG. 2, in another embodiment of the device 10, the second end 42 of the second elongate rod 14 may include a handle engagement element 62 substituted for the wrist engagement element 52. The handle engagement element 62 may be secured to the second elongate rod 14 by the securing element 58, which is configured to facilitate rotation of the handle engagement element 62 about the second elongate rod 14. The handle engagement element 62 may include a clamp 64 and a screw 66, such as a wing nut, extendable through a portion of the clamp 64. The clamp 64 may be sized to grip the handle of a sports device like a vice to secure the device 10 to the sports device. For example, the clamp 64 may be positioned around the handle of a golf club. The screw 66 may then be inserted within the clamp 64 to removably secure the clamp 64 to the handle. Rotation of the screw 68 in a first direction increases the diameter ("D") of the clamp 64 and rotation of the screw 66 in a second direction decreases the diameter "D" of the clamp 64. The second elongate rod 14 may include a bent, or otherwise curved section 69, such that the second end 42 of the second elongate rod 14 is off-set from the second end 42. For example, as shown in FIG. 2, the second elongate rod 14 defines a substantially "S" shaped curved section 69 that includes the second end 42. This curvature allows the handle engagement element 62 to be substantially in-line with the arm engagement element 28. That is, in an exemplary configuration, the midpoint of the handle engagement element 62 is substantially along the same line as the midpoint of the arm engagement element 28.

Figure 3:
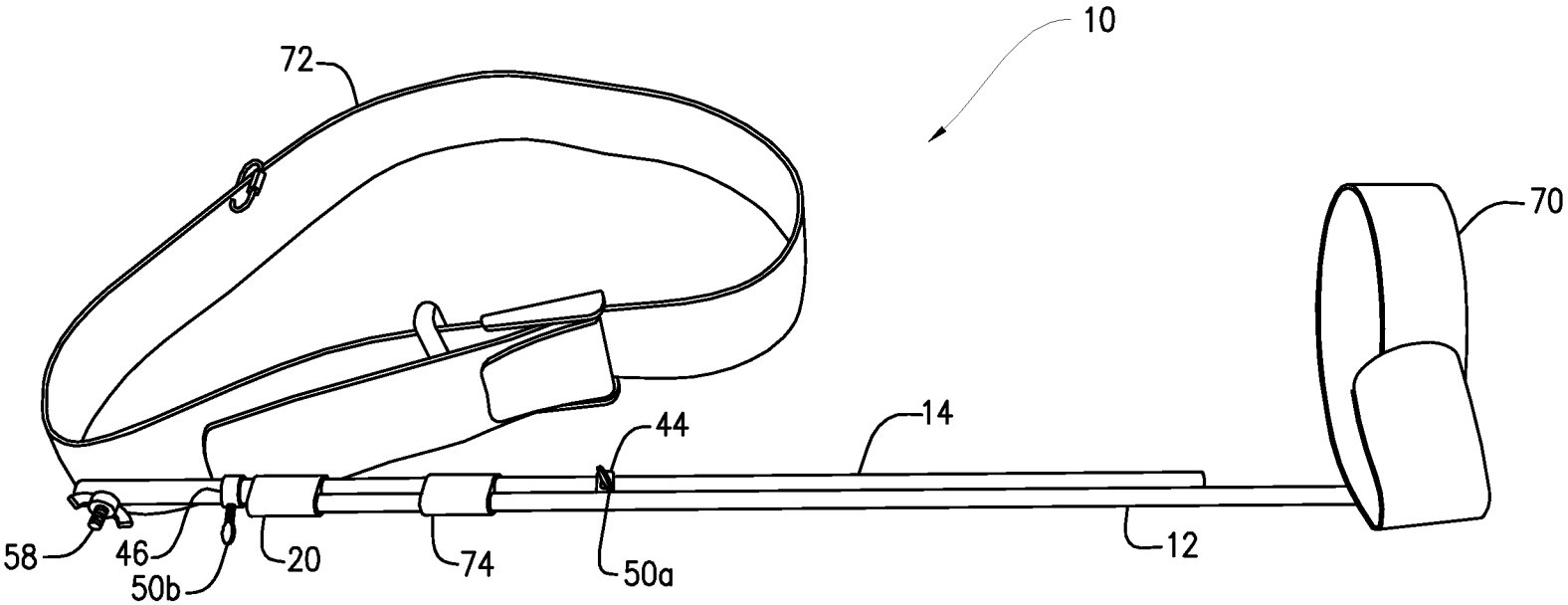
FIG. 3 is a front perspective view of yet another embodiment attachable sports training device constructed in accordance with the principles of the present invention attached to a user's waist and shoe.

Referring now to FIG. 3, in another embodiment of the device 10, the arm engagement element 28 of FIG. 1 is substituted with a shoe engagement element 70, which may include a strap with, for example, a hook and loop fastener, or a buckle, sized to be releasably engageable and wrap around the shoe or foot of a user. The wrist engagement element 52 of FIG. 2 may be substituted for a waist engagement 72, which may also include a clasp, belt, or other fastening element such that the waist engagement 72 is releasably engageable to the user's waist. In this configuration, the first elongate rod 12 and the second elongate rod 14 may be positioned adjacent to the leg of the user and span the distance from the user's waist to the user's shoe. To aid in the proper fit to a particular user, the first stopper 44 and the second stopper 46 may be moved closer together or farther apart along the length of the elongate rod 14 to accommodate the height of the user. Because the first elongate rod 12 and the second elongate 14 may be longer in this embodiment as compared to the embodiment shown in FIG. 1, a second coupling member 74 may be molded or otherwise affixed to the first elongate rod 12 to provide for greater stability when the second elongate rod 14 and the first elongate rod 12 slide with respect to each other.

Figure 4:
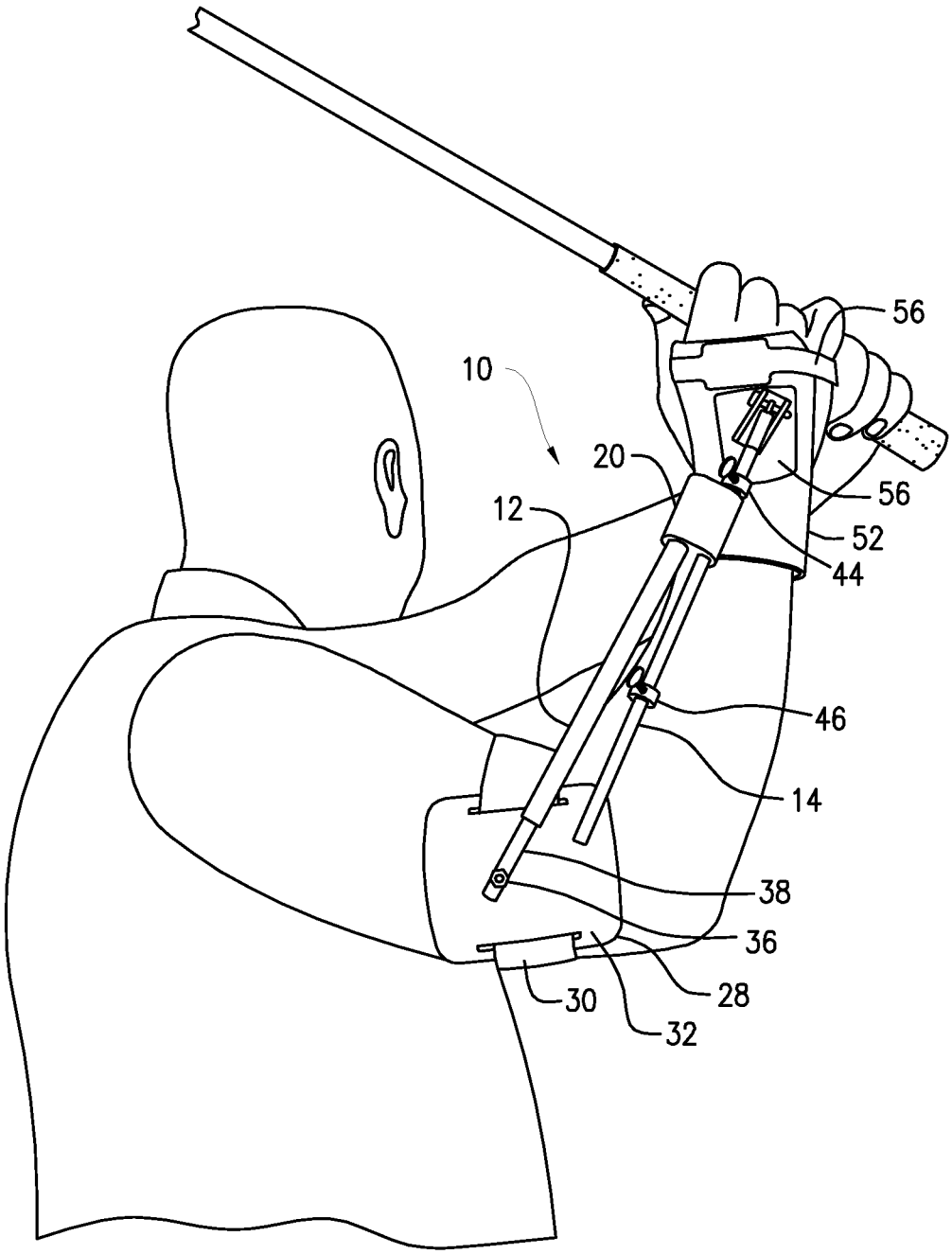
FIG. 4 is a side perspective view of the attachable sports training device shown in FIG. 1 attached to a user.

Referring now to FIG. 4, in an exemplary use of the device 10 shown in FIG. 1 with a golf club, the user may removeably attach the device 10 to his trail arm, in this case, his right arm. The user may attach the arm engagement element 28 or the wrist engagement element 52 in either order. In an exemplary configuration, the user may releasably attach the arm engagement element 28 around the biceps proximal the elbow joint and releasably attach the wrist engagement element 52 around the wrist, while allowing the user's fingers to be in direct contact with the handle of the sports device. The device 10 may restrict the user from flexing his arm inward toward his body, as the coupling member 20 is slideably moved to be in contact with the first stopper 44. For example, as the user's arm is flexed near the top of the backswing, the user's wrist is proximate the user's head. As the user draws the club closer toward his body, his trail arm flexes inward to a predetermined angle defined by the device as a function of the distance between and the position of the first stopper 44 and the second stopper 46. For example, as shown in FIG. 4, the user's arm is prevented from flexing further than the angle shown in the drawing because the coupling member 20 is pressed against the first stopper 44, which prevents the user from flexing his arm inward any farther passed this point, which helps to train the motor skills of the user to not over flex during a backswing.

Figure 6:
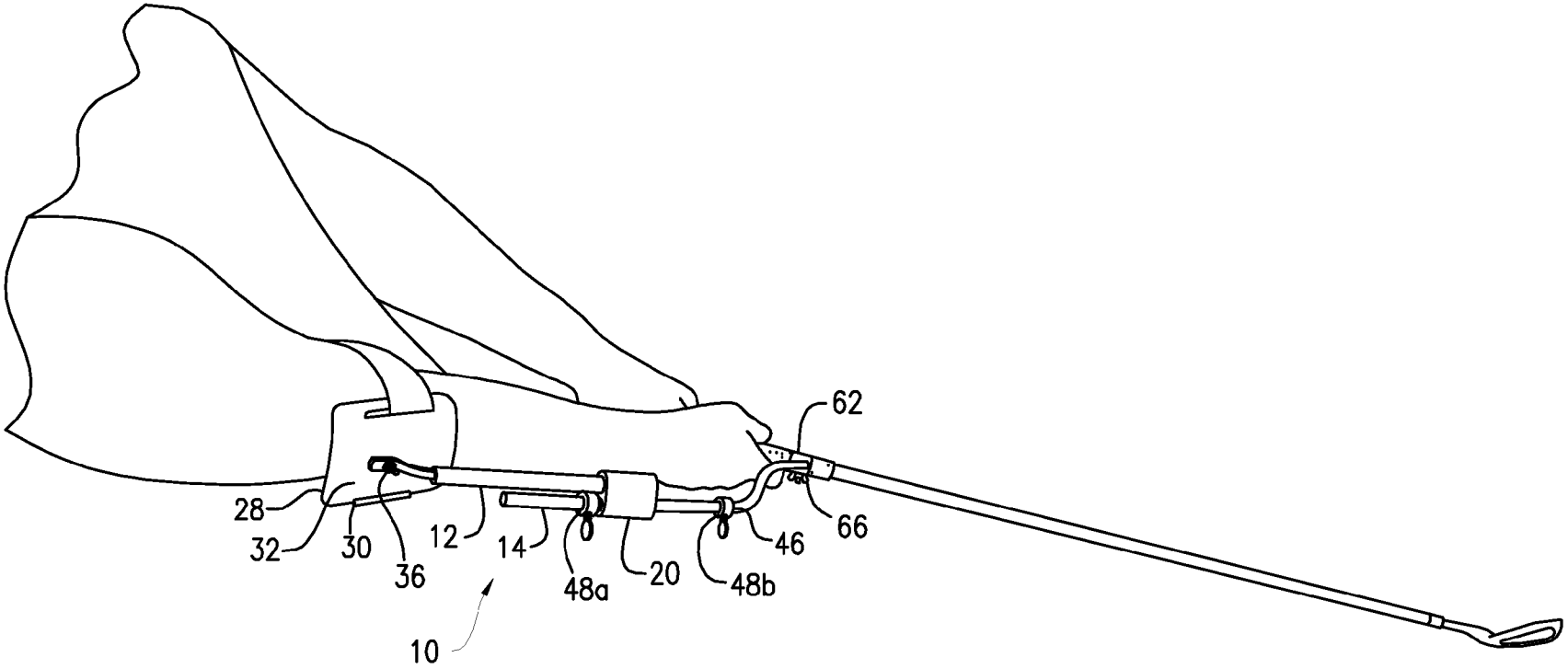
FIG. 6 is a side perspective view of the attachable sports training device shown in FIG. 5 attached to a user who is extending his arms.

The user may further adjust the spacing of the first stopper 44 and the second stopper 46 such that when the user's trail arm is substantially or fully extended, the second stopper 46 is slideably moved in contact with the coupling member 20 and the device 10 restricts the user from extending his trail arm any farther than permitted by the device 10. For example, the configuration shown in FIG. 6 shows the user's trail arm extended 90 degrees from his elbow as the user extends his arms to contact the golf ball during the downswing. In such a configuration, the user is restricted from extending his arm farther than 90 degrees from the pivot point defined by the user's elbow, which helps to train the motor skills of the user to not over extend during a downswing. Should other the user desire to change the allowable extension or flexion angle provided by the device 10, the user can increase the distance between the first stopper 44 and the second stopper 46, or move the second stopper 46 closer to the arm engagement element 28, or the first stopper 44 closer to the wrist engagement element 52.

Figure 5:
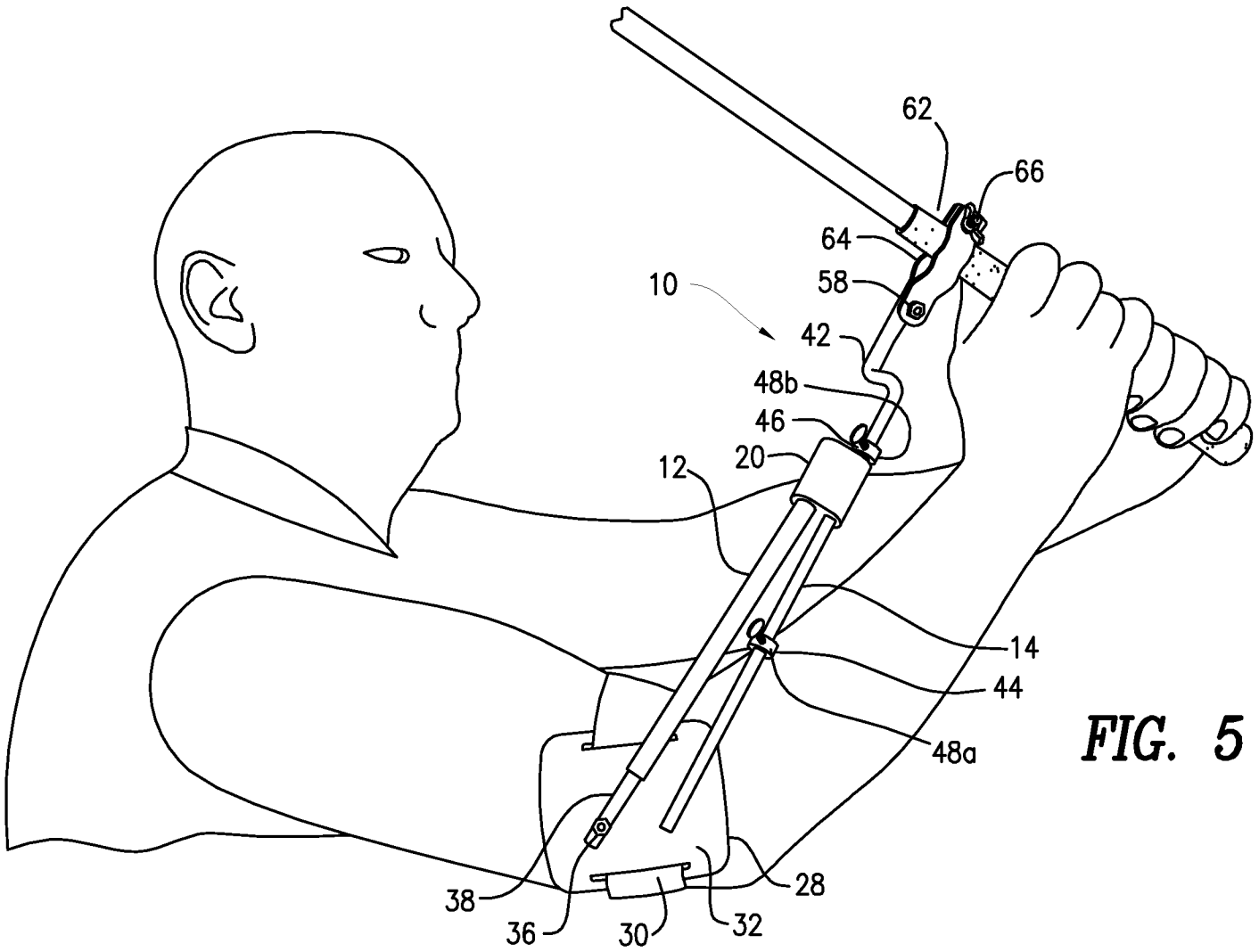
FIG. 5 is a side perspective view of the attachable sports training device shown in FIG. 2 attached to a user.

Referring now to FIGS. 5-6, in an exemplary use of the configuration shown in FIG. 2, the user may removeably affix the arm engagement element 28 in the same manner as discussed about with respect to the configuration shown in FIG. 1, to either arm, and may further releasably affix the handle engagement element 62 around a portion of the sports device, for example, the handle. For example, the user may increase the diameter "D" of the clamp 64 and slide the handle of the sports device, or another portion of the sports device, within the clamp 64. The user may then use the screw 66 to tighten the clamp 64 around the handle of the sports device such that during a swing the device 10 is affixed to the handle.

In an exemplary configuration, the user places his hands above the handle engagement element 62, such that handle engagement element is a distance away from the user's hands as shown in FIGS. 5 and 6. In this configuration, the curvature defined by the second end 42 is configured to provide a space for the hands of the user to grip the handle of the sports device, when the handle engagement element 62 is attached to the handle, without the user's hands contacting the second elongate rod 14. The curvature may further facilitate the first elongate rod 12 and the second elongate rod 14 being both substantially parallel to the user's arm when fully extended, as shown in FIG. 6. In this configuration, the device 10 operates similar to the device 10 shown in FIG. 1, in that the arm engagement element 28 operates identical in this configuration as it does in the configuration shown in FIG. 1. However, the handle engagement element 28 allows the user to rotate his wrists during the backswing and downswing to a greater degree than when the wrist engagement element 52 is attached to the user, because the user's hands are positioned above the handle engagement element 28 as opposed to the being attached to the wrist engagement element 52. In such a configuration, the user can isolate the training of the flexion and extension muscles in his arms during a golf swing. For example, when the handle engagement element 62 is used on the user's lead arm it may be affixed to substantially the midpoint of the shaft of the golf club. In this configuration, the user's lead arm allows the golf club to hinge in a vertical plane of motion. In other words when the leading edge of club face is in proper alignment to the back of lead hand, the handle attachment 62 maintains a square clubface relationship throughout the entire golf swing. When the handle engagement element 62 is used in association with the user's trail arm, it is orientated approximately 45 degree left of center of shaft. This is to complement the correct alignment of the trail arm and to maintain the trail forearm relationship to the golf shaft during the golf swing. In such a configuration, the user can isolate the training of the flexion and extension muscles in his arms during a golf swing.

Figure 7:
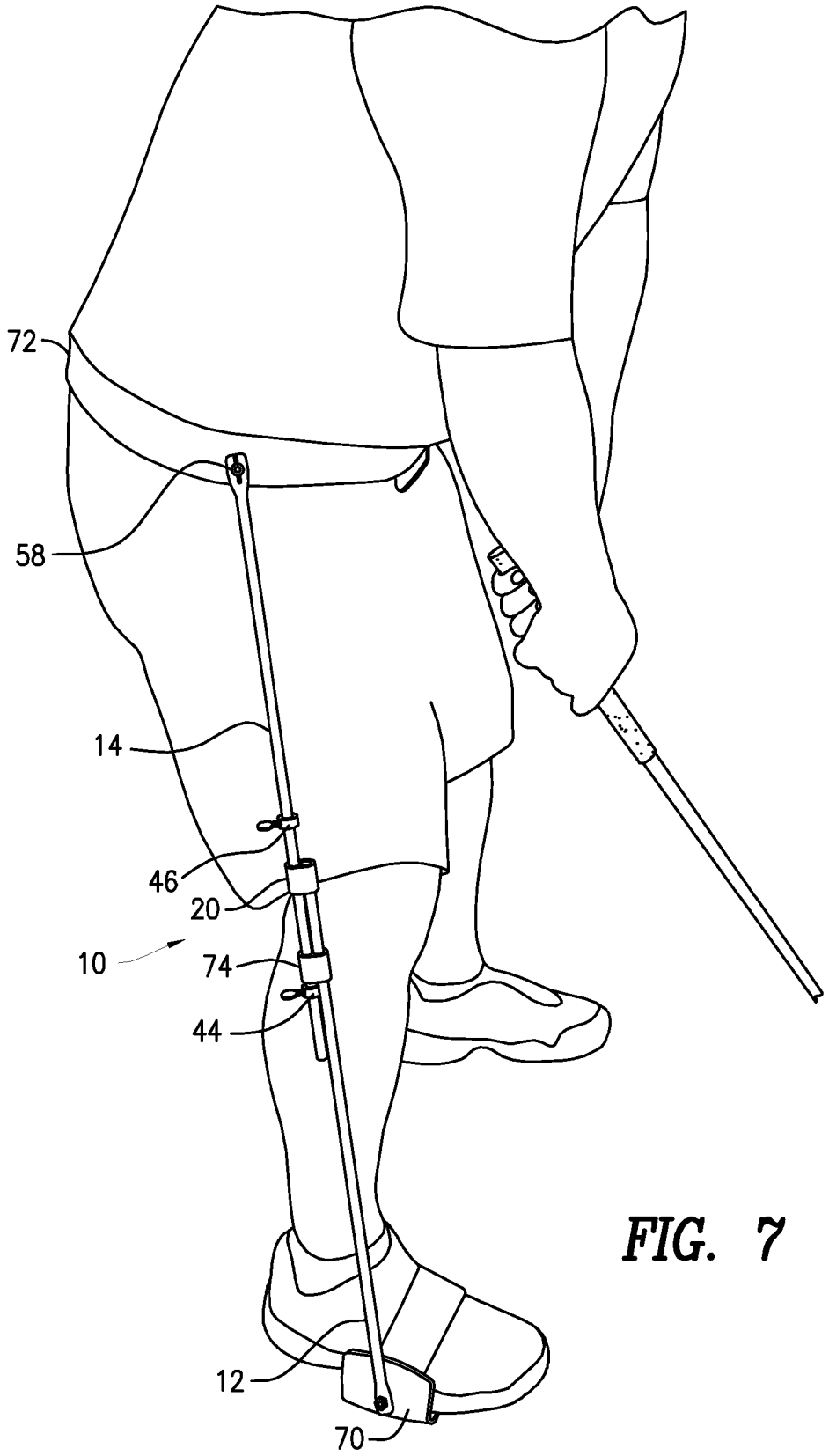
FIG. 7 is a side perspective view of the attachable sports training device shown in FIG. 3 attached to a user.

Referring now to FIG. 7, in an exemplary use of the device 10 shown in FIG. 3, the user may releasably attach, in any order, the shoe engagement element 70 and the waist engagement element 72. In a particular configuration, the device 10 is attached to the lateral side of the user's trail leg such that the device 10 is substantially parallel with the user's leg when the leg is fully extended. In this configuration, the first elongate rod 12 and the second elongate rod 14 cooperate to restrict the over-extension and/or over flexion of knee joint during the backswing and downswing of a golf swing, in the same manner as the configuration shown in FIG. 1. For example, as the user draws the club backward, the coupling member 20 may contact the second stopper 46 to prevent flexion of the knee beyond that point. As the user brings the club downward and follows through the swing, the second coupling member 74 will contact the first stopper 44 to prevent over-flexion of the knee, and thus train the appropriate muscles.

In other configurations, the shoe engagement element 70 may be attached to the user's lead leg with the waist engagement element 72 engaging the second elongate rod 14 on the lead leg side of the user's body. In this configuration, the second stopper 46 limits the amount of knee flexion in the backswing and the first stopper 44 is spaced a distance away from the second coupling member 74 to allow a straightening of the lead leg during the forward swing and allowing full extension of the lead knee and leg.

Figure 8:
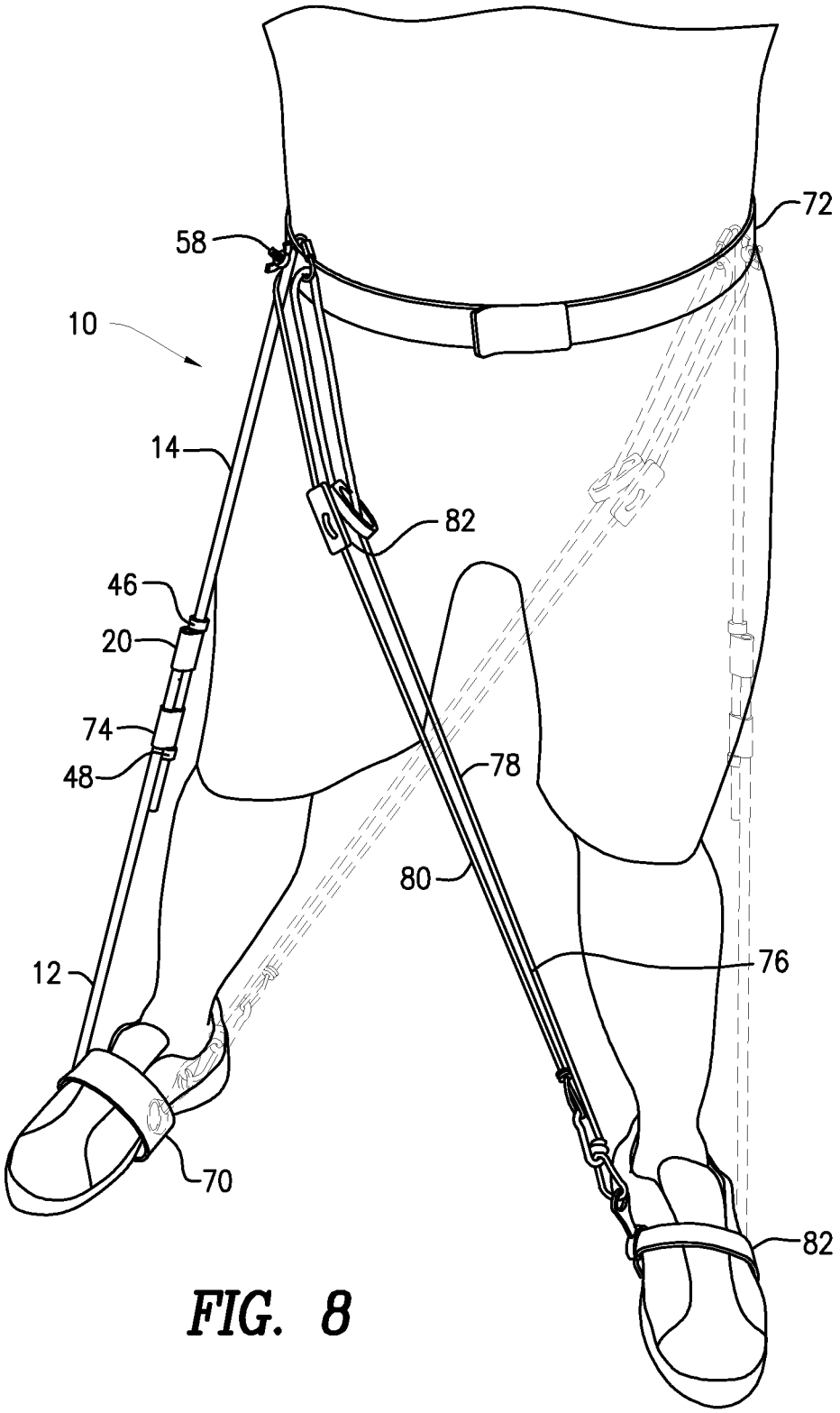
FIG. 8 is a front perspective view of the attachable sports training device shown in FIG. 7 attached to a user and including a bungee accessory system.

Referring now to FIG. 8, in another configuration, a bungee accessory system 76 may be releaseably engaged to the waist engagement element 72. In particular, the bungee accessory system 76 may include a first resilient band 78 releasably engageable to the waist engagement element 74, for example, by a clip or other fastener, and a indexing cord 80 releaseably engageable to the waist engagement element 74 and wrapped around a portion of the second elongate rod 14. For example, the first resilient band 78 and the indexing cord 80 may be both releasably engaged to the waist engagement element 74 at substantially the same location. The first resilient band 78 and the indexing cord 80 may further be releasably engageable to a second shoe engagement element 82, by a clip or other fastener, which is releasably engaged to the user's shoe on the opposite foot to which the shoe engagement element 70 is attached. In such a configuration, the a bungee accessory system 76 extends across the user's lower body and is configured to provide tension to the user's lead leg shoe to prevent radial movement of the user's foot during a golf swing. The indexing cord 80 limits the amount of trail hip rotation and create stability in the trail hip during the backswing allowing a coiling motion of the upper body and stable lower body. The tension created by the first resilient band 78 assists in engaging the hamstring, gluteus muscles, and quadriceps, which teaches a golfer how to create a ground force reaction. The tension further enables the golfer to build stability in their lower body and greatly improve the storing and releasing of this in the ground force reaction golfer's swing. In other configurations, the bungee accessory system 76 or the first resilient bad 78 alone may be releasably affixed to the first elongate rod 12 and/or the second elongate rod 14 in any of the above embodiments and further affixed to the arm engagement element 28 or the wrist engagement element 62 to provide for a particular range of motion. The bungee accessory system 76 may further be connected to straps sized to be wrapped around the user's knees and further engageable with the shoe engagement element 82. In another configuration, the second shoe engagement element 82 may be replaced by an anchor (not shown) which anchors the first resilient band 78 and the indexing cord 80 to the anchor, which is further releasably affixed to the ground or a fixed platform.

A tension adjustment mechanism 82 may be included with the bungee accessory system 76 and configured to adjust the tension in the either or both of the first resilient band 78 and the indexing cord 80. For example, the tension adjustment mechanism 82 may be an adjustable clip configured to decrease the slack on either or both the first resilient band 78 and the indexing cord 80.

Figure 9:
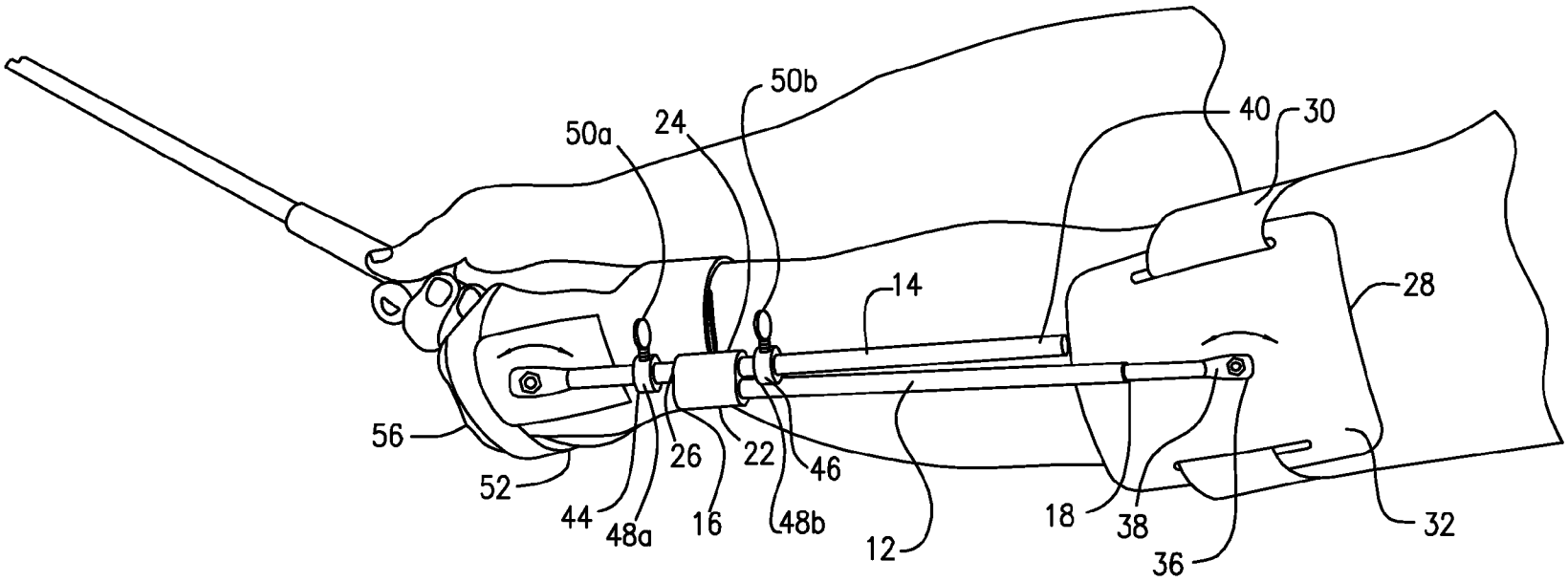
FIG. 9 is a front perspective view of another embodiment of the attachable sports training device constructed in accordance with the principles of the present invention attachable to a user's lead arm.

Referring now to FIG. 9, in another configuration of the device 10 shown in FIG. 1, the device 10 may be releasably attached to the user's lead arm in addition to the user's trail arm. As shown in FIG. 9, the arm engagement element 38 is releasably engaged to a portion of the user's lead arm above the elbow. The wrist engagement element 52 may be wrapped around the wrist of the lead arm and may include the securing element 58 to provide for rotational movement of the wrist engagement element 52. However, in this embodiment, the fulcrum 60 is removed to preventing the user's wrist from pivoting with respect to the second elongate rod 14. In this configuration, the first stopper 44 prevents over flexion of the user's lead arm during the backswing, and the first stopper prevents over extension and the second stopper 46 prevents over extension of the user's lead arm during the downswing and follow through.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A sports training device, comprising:

a first elongate rod;

a user engagement element coupled to the first elongate rod, the user engagement element being sized and configured to be releasably disposed around a first portion of a user's body;

a second elongate rod movably coupled to and longitudinally aligned with the first elongate rod;

a second engagement element coupled to the second elongate rod, the second engagement element being sized and configured to releasably couple to at least one from the group consisting of a second portion of the user's body different than the first portion and a sports device;

a first stopper movably coupled to the second elongate rod;

a second stopper movably coupled to the second elongate rod; and a portion of the first elongate rod being slideable during use between the first stopper and the second stopper.

2. The sports training device of claim 1, wherein the second engagement element includes a clamp configured to engage a handle of a sports device.

3. The sports training device of claim 1, wherein the first elongate rod includes a first end and a second end, and wherein the first elongate rod includes a coupling element included at the first end, and wherein the user engagement element is coupled to the second end.

4. The sports training device of claim 3, wherein the coupling element defines a passage, and wherein a portion of the second elongate rod is slideably received within the passage.

5. The sports training device of claim 1, wherein the user engagement element includes a strap sized to wrap around a human arm.

6. The sports training device of claim 5, wherein the second engagement element includes a strap sized to wrap around a human wrist.

7. The sports training device of claim 1, wherein the user engagement element includes a strap sized to wrap around a human waist.

8. The sports training device of claim 1, wherein the user engagement element is rotatably coupled to the first elongate rod.

9. The sports training device of claim 1, wherein the second engagement element is pivotally coupled to the second elongate rod.

10. The sports training device of claim 1, wherein the second elongate rod defines a curved section proximate the second engagement element configured to align a midpoint of second engagement element with a midpoint of the user engagement element.

11. The sports training device of claim 1, wherein the second rod is arranged in a side-by-side relationship with the first elongate rod.

12. A sports training device, comprising:

a first elongate rod having a first length, a first end, and a second end;

a coupling element disposed at the first end, the coupling element having a second length less than the first length, the coupling element further defining a passage there through;

a user engagement element coupled to the second end, the user engagement element being configured to releasably couple to an arm of a user's;

a second elongate rod slideably received within the passage;

a second engagement element being coupled to the second elongate rod, the second engagement element being configured to releasably couple to a sports device;

a first collar and a second collar movably coupled to the second elongate rod; and the coupling element being slideable between the first collar and the second collar;

a portion of the first elongate rod being slideable during use between the first collar and the second collar.

13. The sports training device of claim 12, wherein the second engagement element includes a clamp configured to engage a handle of the sports device.

14. The sports training device of claim 12, wherein the user engagement element is rotatably coupled to the first elongate rod.

15. The sports training device of claim 12, wherein the second engagement element is pivotally coupled to the second elongate rod.

16. The sports training device of claim 12, wherein the user engagement element includes a strap sized to wrap around at least one of a human arm and a human wrist the arm.

17. The sports training device of claim 12, wherein the second elongate rod has a third length, and wherein the first length is larger than the third length.

18. A sports training device, comprising:

a first elongate rod having a first length, a first end, and a second end;

a coupling element disposed at the first end, the coupling element having a second length less than the first length, the coupling element further defining a passage there through;

a first user engagement element rotatably coupled to the second end, the first user engagement element being sized and configured to releasably couple to a wrist and hand of a user's;

a second elongate rod slideably received within the passage;

a second user engagement element being pivotally and rotatably coupled to the second elongate rod, the second user engagement element including a strap and a plate and being sized to releasably coupled to a portion of a user's upper arm;

a first collar and a second collar movably coupled to the second elongate rod; and the coupling element being slideable between the first collar and the second collar;

a portion of the first elongate rod being slideable during use between the first collar and the second collar.

* * * * *